US011109474B2

(12) United States Patent
Choi et al.

(10) Patent No.: US 11,109,474 B2
(45) Date of Patent: Aug. 31, 2021

(54) EXTREME ULTRAVIOLET GENERATION APPARATUS

(71) Applicant: SAMSUNG ELECTRONICS CO., LTD., Suwon-si (KR)

(72) Inventors: In Ho Choi, Seoul (KR); Min Seok Choi, Hwaseong-si (KR); Jeong-Gil Kim, Hwaseong-si (KR); Hyuck Shin, Bucheon-si (KR); In Jae Lee, Seoul (KR); Sung Ho Jang, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/861,595

(22) Filed: Apr. 29, 2020

(65) Prior Publication Data

US 2021/0092825 A1 Mar. 25, 2021

(30) Foreign Application Priority Data

Sep. 24, 2019 (KR) ..... 10-2019-0117195

(51) Int. Cl.
*H05G 2/00* (2006.01)

(52) U.S. Cl.
CPC ..... *H05G 2/008* (2013.01); *H05G 2/006* (2013.01)

(58) Field of Classification Search
CPC ..... H05G 2/008; H05G 2/006
See application file for complete search history.

(56) References Cited

U.S. PATENT DOCUMENTS

| | | | |
|---|---|---|---|
| 7,087,914 | B2 | 8/2006 | Akins et al. |
| 7,615,766 | B2 | 11/2009 | Nakano |
| 8,598,551 | B2 | 12/2013 | Mestrom et al. |
| 9,538,628 | B1 | 1/2017 | Wu et al. |
| 9,678,431 | B2 | 6/2017 | Lu et al. |
| 9,699,877 | B2 | 7/2017 | Hori et al. |
| 9,961,755 | B2 | 5/2018 | Umeda et al. |
| 10,306,743 | B1 | 5/2019 | Hori et al. |
| 2018/0136541 | A1 | 5/2018 | Rafac |
| 2019/0154013 | A1 | 5/2019 | Lazarev |

*Primary Examiner* — Nicole M Ippolito
*Assistant Examiner* — Hanway Chang
(74) *Attorney, Agent, or Firm* — Sughrue Mion, PLLC

(57) ABSTRACT

An extreme ultraviolet generation apparatus is provided. The extreme ultraviolet generation apparatus includes a chamber, a droplet generator configured to provide a droplet into the chamber, a shroud which extends along a movement path of the droplet inside the chamber and surrounds the movement path of the droplet, a charging unit configured to charge the droplet, a monitoring unit configured to measure a position of the charged droplet, an alignment unit including at least one electromagnet, the alignment unit configured to correct the position of the charged droplet within the shroud using the at least one electromagnet, and an acceleration unit configured to accelerate the charged droplet after the position of the charged droplet has been corrected.

20 Claims, 19 Drawing Sheets

EXTREME ULTRAVIOLET GENERATION APPARATUS

This application claims the benefit of Korean Patent Application No. 10-2019-0117195, filed on Sep. 24, 2019, in the Korean Intellectual Property Office, the disclosure of which is incorporated herein in its entirety by reference.

BACKGROUND

1. Technical Field

The present disclosure relates to an extreme ultraviolet generation apparatus.

2. Description of the Related Art

A photolithography process includes a photoresist coating process for forming a photoresist layer on a semiconductor substrate, a soft-bake process for initially curing the photoresist layer by volatilizing a solvent from the photoresist layer, an exposure process for transferring a specific image pattern onto the initially cured photoresist layer, a development process for developing the photoresist layer to which the pattern has been transferred, and a post-bake process for curing a photoresist pattern formed by the development.

Here, since the wavelength of light is reduced as the size of the pattern on the substrate is reduced, the processes are now performed using extreme ultraviolet light. For example, the exposure process or an inspection process may be performed using extreme ultraviolet light.

SUMMARY

Aspects of the present disclosure provide an extreme ultraviolet generation apparatus which improves the delivery frequency of droplets while maintaining an interval between the droplets by accelerating the droplets using an acceleration unit.

Aspects of the present disclosure also provide an extreme ultraviolet generation apparatus which improves the accuracy of delivering a droplet by measuring the position of the droplet using a monitoring unit and correcting the position of the droplet using an alignment unit.

Aspects of the present disclosure also provide an extreme ultraviolet generation apparatus in which a charging unit, a monitoring unit, an alignment unit and an acceleration unit which are components for accelerating a droplet are disposed in a shroud to improve the degree of integration of extreme ultraviolet light by minimizing the interference generated in the process of integrating the extreme ultraviolet light.

According to a non-limiting example embodiment of the present disclosure, there is provided an extreme ultraviolet generation apparatus comprising a chamber; a droplet generator configured to provide a droplet into the chamber; a shroud which extends along a movement path of the droplet inside the chamber and surrounds the movement path of the droplet; a charging unit configured to charge the droplet; a monitoring unit configured to measure a position of the charged droplet; an alignment unit comprising at least one electromagnet, the alignment unit configured to correct the position of the charged droplet within the shroud using the at least one electromagnet; and an acceleration unit configured to accelerate the charged droplet after the position of the charged droplet has been corrected.

According to a non-limiting example embodiment of the present disclosure, there is provided an extreme ultraviolet generation apparatus comprising a chamber; a droplet generator configured to provide a droplet into the chamber; a shroud which extends along a movement path of the droplet inside the chamber and surrounds the movement path of the droplet; a charging unit which is disposed in the shroud and configured to charge the droplet; an alignment unit comprising at least one electromagnet exposed to an inner circumferential surface of the shroud, the alignment unit disposed in the shroud and configured to correct a position of the charged droplet using the at least one electromagnet; and a light source configured to provide a laser light to the charged droplet.

According to a non-limiting example embodiment of the present disclosure, there is provided an extreme ultraviolet generation apparatus comprising a chamber; a droplet generator configured to provide a droplet into the chamber; a shroud which extends along a movement path of the droplet inside the chamber and surrounds the movement path of the droplet; a charging unit configured to charge the droplet; a monitoring unit configured to measure a position of the charged droplet using an electric field; an alignment unit comprising at least one electromagnet, the alignment unit disposed between an outer circumferential surface of the shroud and an inner circumferential surface of the shroud and configured to correct the position of the charged droplet using the at least one electromagnet; an acceleration unit comprising an acceleration electrode, the acceleration unit configured to accelerate the charged droplet, after the position of the charged droplet has been corrected, using the acceleration electrode; and a light source configured to pretreat the charged droplet by providing a first laser light to the charged droplet reaching a first position inside the chamber and further configured to generate a plasma by providing a second laser light to the charged droplet reaching a second position farther away from the droplet generator than the first position, wherein the charging unit, the monitoring unit, the alignment unit, and the acceleration unit are sequentially disposed in the shroud along the movement path of the droplet.

However, aspects of the present disclosure are not restricted to the one set forth herein. The above and other aspects of the present disclosure will become more apparent to one of ordinary skill in the art to which the present disclosure pertains by referencing the detailed description of the present disclosure given below.

BRIEF DESCRIPTION OF THE DRAWINGS

These and/or other aspects will become apparent and more readily appreciated from the following description of non-limiting example embodiments, taken in conjunction with the accompanying drawings in which.

DETAILED DESCRIPTION

An extreme ultraviolet generation apparatus according to non-limiting example embodiments will now be described with reference to FIGS. 1 through 8.

Figure 1:
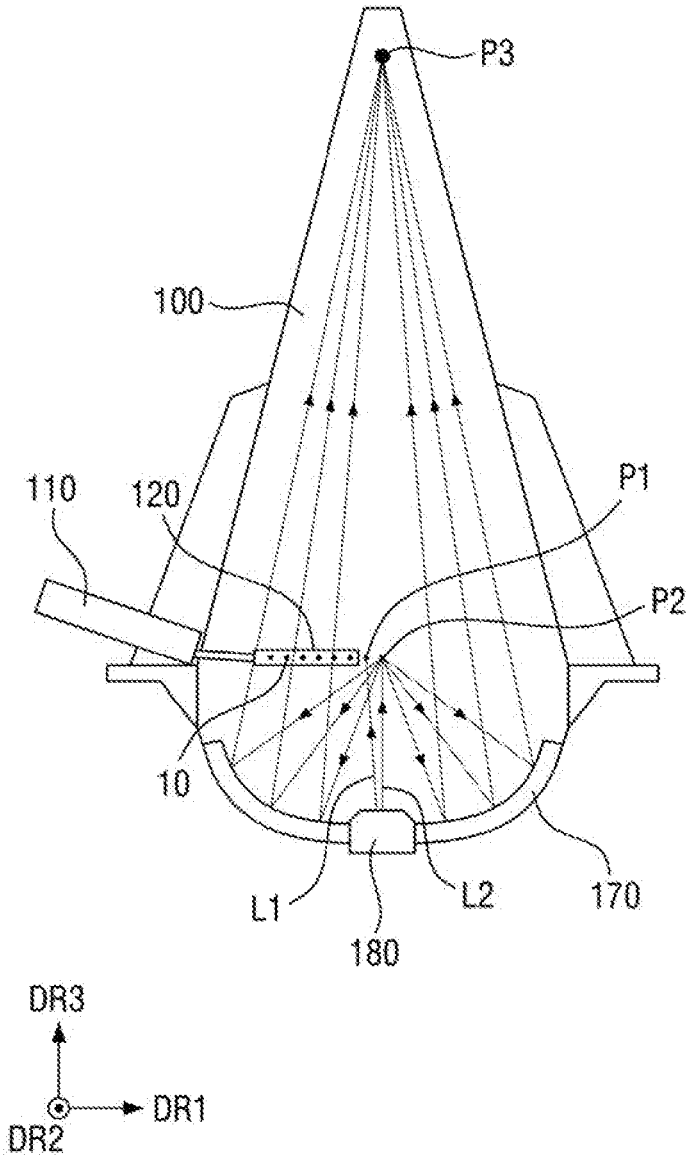
FIG. 1 is a schematic view of an extreme ultraviolet generation apparatus according to non-limiting example embodiments.
Figure 2:
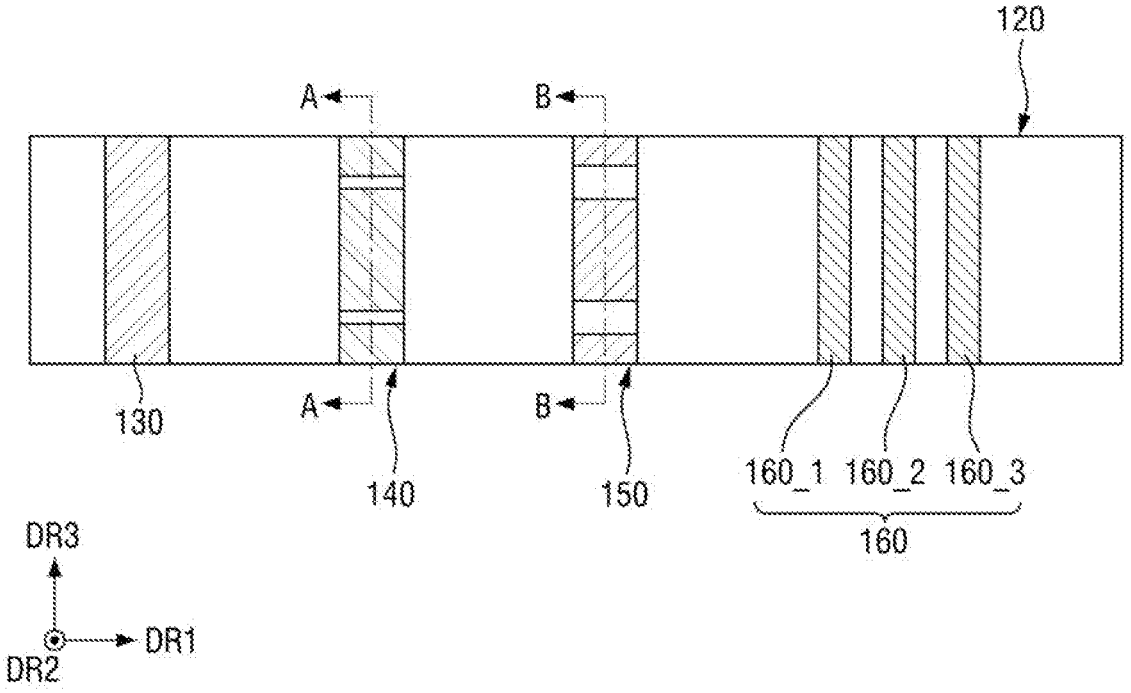
FIG. 2 illustrates a shroud used in the extreme ultraviolet generation apparatus according to the non-limiting example embodiments.
Figure 3:
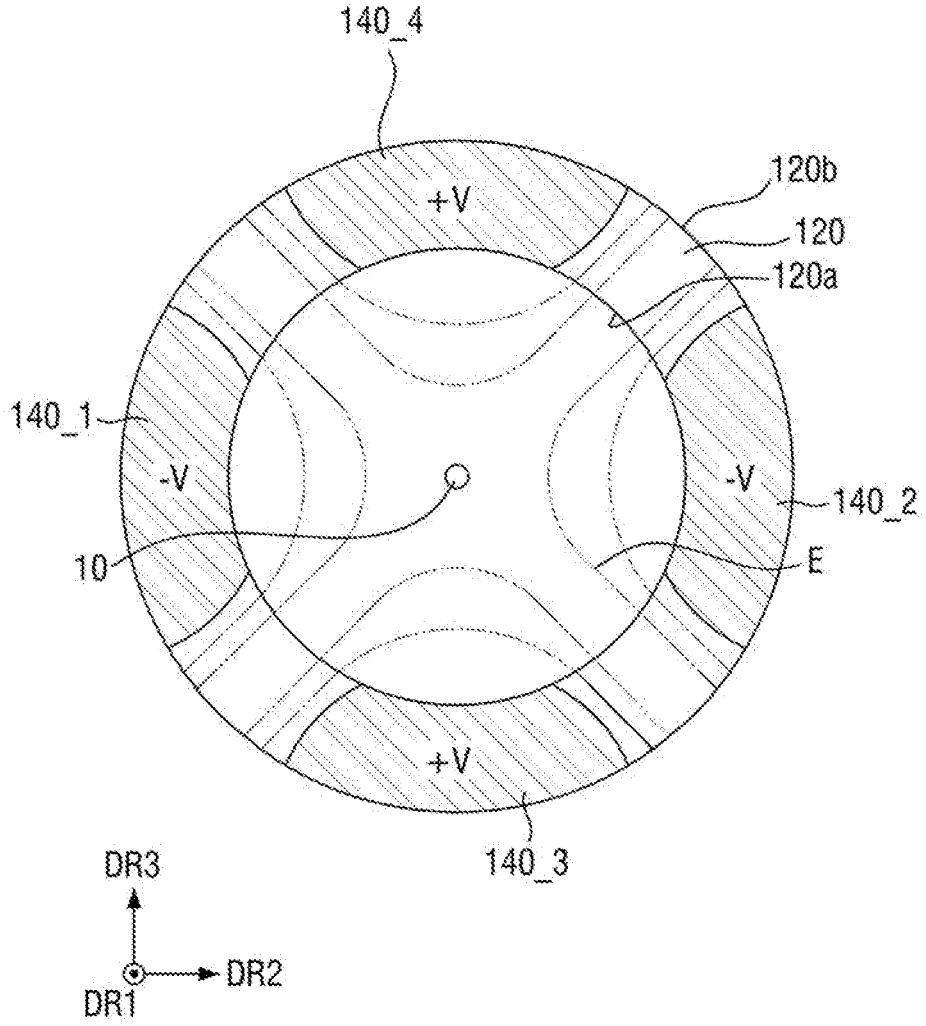
FIG. 3 is a cross-sectional view taken along line A-A of FIG. 2.
Figure 4:
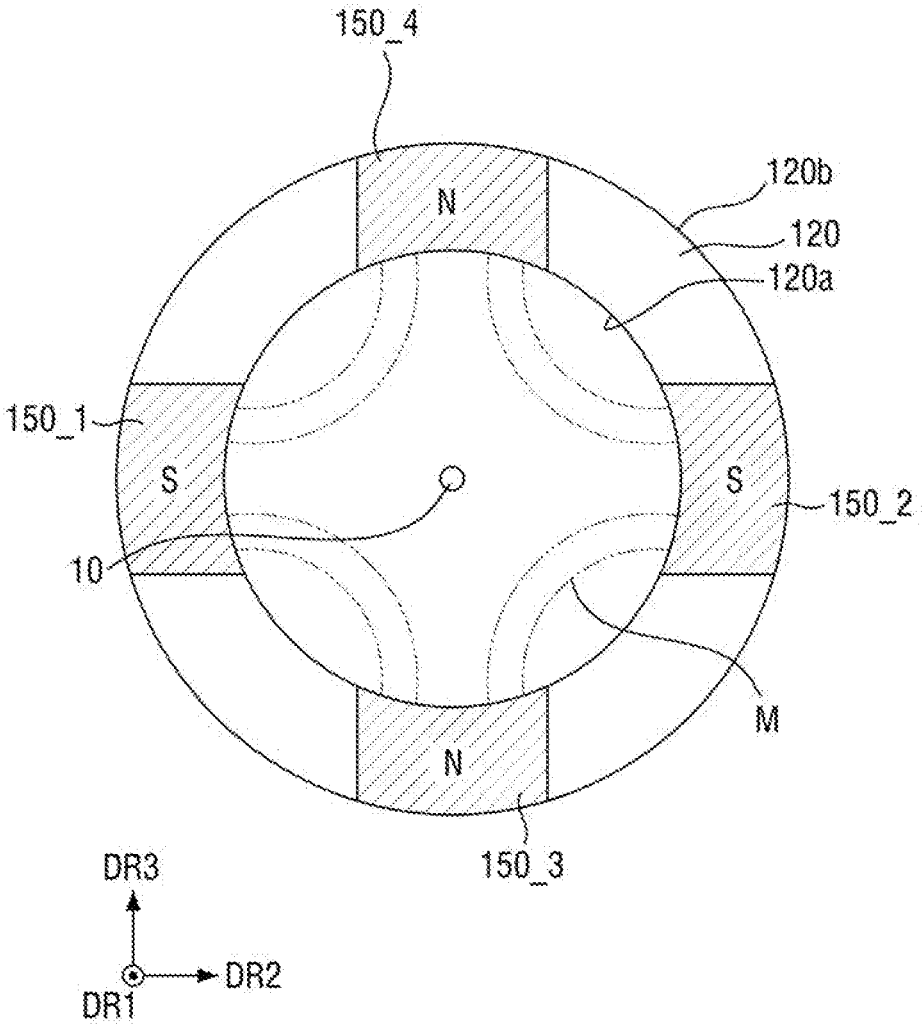
FIG. 4 is a cross-sectional view taken along line B-B of FIG. 2.

FIG. 1 is a schematic view of an extreme ultraviolet generation apparatus according to non-limiting example embodiments. FIG. 2 illustrates a shroud 120 used in the extreme ultraviolet generation apparatus according to non-limiting example embodiments. FIG. 3 is a cross-sectional view taken along line A-A of FIG. 2. FIG. 4 is a cross-sectional view taken along line B-B of FIG. 2. FIGS. 5 through 8 are diagrams for explaining an acceleration unit 160 used in the extreme ultraviolet generation apparatus according to non-limiting example embodiments.

Referring to FIGS. 1 through 8, the extreme ultraviolet generation apparatus according to non-limiting example embodiments may include a chamber 100, a droplet generator 110, the shroud 120, a charging unit 130, a monitoring unit 140, an alignment unit 150, the acceleration unit 160, a reflection unit 170, and a light source 180.

The chamber 100 may provide an internal space in which extreme ultraviolet light is generated. For example, the inside of the chamber 100 may be in a vacuum. Since the inside of the chamber 100 is in a vacuum, light needed to generate extreme ultraviolet light can be prevented from being absorbed in the atmosphere.

The droplet generator 110 may be connected to a side of the chamber 100. The droplet generator 110 may provide a droplet 10, which is a raw material for generating extreme ultraviolet light, into the chamber 100. The droplet generator 110 may provide the droplet 10 into the chamber 100 in a first direction DR1. Although the first direction DR1 is a horizontal direction in FIG. 1, this is merely for ease of description, and the present disclosure is not limited thereto. That is, in non-limiting example embodiments, the first direction DR1 may be a direction perpendicular to the ground, and the droplet 10 may be provided vertically down to a second position P2 inside the chamber 100.

The shroud 120 may be disposed inside the chamber 100. The shroud 120 may extend in the first direction DR1 along a path in which the droplet 10 generated by the droplet generator 110 moves. The shroud 120 may surround the path in which the droplet 10 moves. The shroud 120 may be shaped like, for example, a circular cylinder with a hollow space inside.

The shroud 120 may include, for example, an opaque material.

The light source 180 may provide light into the chamber 100. Although the light source 180 is disposed on a side of the chamber 100 in FIG. 1, the present disclosure is not limited thereto. That is, in non-limiting example embodiments, the light source 180 may be disposed outside the chamber 100.

Light provided from the light source 180 may be, for example, laser light. The laser light provided from the light source 180 may be provided to the droplet 10 that passes through the shroud 120.

First laser light L1 provided from the light source 180 may be provided to the droplet 10 reaching a first position P1 inside the chamber 100. Accordingly, the droplet 10 may be pretreated. In addition, second laser light L2 provided from the light source 180 may be provided to the droplet 10 reaching the second position P2 farther away from the droplet generator 110 than the first position P1. Accordingly, plasma may be generated. In this case, extreme ultraviolet light may be generated from the plasma.

The reflection unit 170 may be disposed on a side of the chamber 100 on which the light source 180 is disposed. The reflection unit 170 may concentrate the extreme ultraviolet light generated from the plasma at a third position P3 by reflecting the extreme ultraviolet light. The reflection unit 170 may comprise at least one mirror.

As illustrated in FIG. 2, the charging unit 130, the monitoring unit 140, the alignment unit 150, and the acceleration unit 160 may be disposed in the shroud 120. The charging unit 130, the monitoring unit 140, the alignment unit 150, and the acceleration unit 160 may be sequentially disposed in the first direction DR1 along the path in which the droplet 10 moves.

The charging unit 130 may be disposed in the shroud 120. Sidewalls of the charging unit 130 may contact the shroud 120. The charging unit 130 may be disposed, for example, between an inner circumferential surface 120*a* of the shroud 120 and an outer circumferential surface 120*b* of the shroud 120.

The charging unit 130 may, for example, negatively charge the droplet 10. Specifically, the charging unit 130 may negatively charge the droplet 10 generated by the droplet generator 110 and provided into the shroud 120. In non-limiting example embodiments, the charging unit 130 may also positively charge the droplet 10.

The monitoring unit 140 may be disposed in the shroud 120. The monitoring unit 140 may be spaced apart from the charging unit 130 in the first direction DR1. Sidewalls of the monitoring unit 140 may contact the shroud 120. The monitoring unit 140 may be disposed, for example, between the inner circumferential surface 120*a* of the shroud 120 and the outer circumferential surface 120*b* of the shroud 120.

As illustrated in FIG. 3, the monitoring unit 140 may include, for example, first through fourth monitoring electrodes 140_1 through 140_4. Although the monitoring unit 140 includes four monitoring electrodes in FIG. 3, this is merely for ease of description, and the number of monitoring electrodes included in the monitoring unit 140 is not limited.

The first through fourth monitoring electrodes 140_1 through 140_4 may be spaced apart from each other. Specifically, the first monitoring electrode 140_1 may be spaced apart from the second monitoring electrode 140_2 in a second direction DR2. The third monitoring electrode 140_3 may be spaced apart from the fourth monitoring electrode 140_4 in a third direction DR3. Here, the second direction DR2 may be perpendicular to the third direction DR3. In addition, each of the second direction DR2 and the third direction DR3 may be perpendicular to the first direction DR1.

Each of the first through fourth monitoring electrodes 140_1 through 140_4 may be disposed between the inner circumferential surface 120*a* of the shroud 120 and the outer circumferential surface 120*b* of the shroud 120. However, the present disclosure is not limited thereto.

A part of each of the first through fourth monitoring electrodes 140_1 through 140_4 may be exposed to the inner circumferential surface 120*a* of the shroud 120. However, the present disclosure is not limited thereto.

The shroud 120 may be disposed between the first monitoring electrode 140_1 and the third monitoring electrode 140_3, between the third monitoring electrode 140_3 and the second monitoring electrode 140_2, between the second monitoring electrode 140_2 and the fourth monitoring electrode 140_4, and between the fourth monitoring electrode 140_4 and the first monitoring electrode 140_1.

A negative voltage −V may be applied to each of the first monitoring electrode 140_1 and the second monitoring electrode 140_2. In addition, a positive voltage +V may be applied to each of the third monitoring electrode 140_3 and the fourth monitoring electrode 140_4.

An electric field E may be formed inside the shroud 120 in which the monitoring unit 140 is disposed. Specifically, the electric field E may be formed inside the shroud 120 between the first through fourth monitoring electrodes 140_1 through 140_4.

The monitoring unit 140 may measure the position of the charged droplet 10 using the electric field E. Specifically, the monitoring unit 140 may measure the position of the charged droplet 10 by sensing a change in the electric field E when the charged droplet 10 passes through the inside of the shroud 120 in which the monitoring unit 140 is disposed. In this case, the monitoring unit 140 may measure the position of the charged droplet 10 by measuring a distance of the charged droplet 10 from a center of the shroud 120.

The alignment unit 150 may be disposed in the shroud 120. The alignment unit 150 may be spaced apart from the monitoring unit 140 in the first direction DR1. Sidewalls of the alignment unit 150 may contact the shroud 120. The alignment unit 150 may be disposed, for example, between the inner circumferential surface 120*a* of the shroud 120 and the outer circumferential surface 120*b* of the shroud 120.

As illustrated in FIG. 4, the alignment unit 150 may include, for example, first through fourth electromagnets 150_1 through 150_4. Although the alignment unit 150 includes four electromagnets in FIG. 4, this is merely for ease of description, and the number of electromagnets included in the alignment unit 150 is not limited.

The first through fourth electromagnets 150_1 through 150_4 may be spaced apart from each other. Specifically, the first electromagnet 150_1 may be spaced apart from the second electromagnet 150_2 in the second direction DR2. The third electromagnet 150_3 may be spaced apart from the fourth electromagnet 150_4 in the third direction DR3.

Each of the first through fourth electromagnets 150_1 through 150_4 may be disposed between the inner circumferential surface 120*a* of the shroud 120 and the outer circumferential surface 120*b* of the shroud 120. However, the present disclosure is not limited thereto.

A part of each of the first through fourth electromagnets 150_1 through 150_4 may be exposed to the inner circumferential surface 120*a* of the shroud 120. However, the present disclosure is not limited thereto.

The shroud 120 may be disposed between the first electromagnet 150_1 and the third electromagnet 150_3, between the third electromagnet 150_3 and the second electromagnet 150_2, between the second electromagnet 150_2 and the fourth electromagnet 150_4, and between the fourth electromagnet 150_4 and the first electromagnet 150_1.

Each of the first electromagnet 150_1 and the second electromagnet 150_2 may have magnetism of a south (S) pole. In addition, each of the third electromagnet 150_3 and the fourth electromagnet 150_4 may have magnetism of a north (N) pole. However, the present disclosure is not limited thereto. That is, in non-limiting example embodiments, each of the first electromagnet 150_1 and the second electromagnet 150_2 may have the magnetism of the N pole. In addition, each of the third electromagnet 150_3 and the fourth electromagnet 150_4 may have the magnetism of the S pole.

A magnetic field M may be formed inside the shroud 120 in which the alignment unit 150 is disposed. Specifically, the magnetic field M may be formed inside the shroud 120 between the first through fourth electromagnets 150_1 through 150_4.

The alignment unit 150 may correct the position of the charged droplet 10 using the magnetic field M. Specifically, the alignment unit 150 may correct the position of the charged droplet 10 using the magnetic field M when the charged droplet 10 passes through the inside of the shroud 120 in which the alignment unit 150 is disposed.

In this case, the alignment unit 150 may correct the position of the charged droplet 10 by asymmetrically applying a current to each of the first through fourth electromagnets 150_1 through 150_4 according to a position error of the charged droplet 10 measured by the monitoring unit 140. Correcting the position of the charged droplet 10 refers to positioning the charged droplet 10 at the center of the shroud 120 in the cross section of FIG. 4.

The acceleration unit 160 may be disposed in the shroud 120. The acceleration unit 160 may be spaced apart from the alignment unit 150 in the first direction DR1. Sidewalls of the acceleration unit 160 may contact the shroud 120. The acceleration unit 160 may be disposed, for example, between the inner circumferential surface 120*a* of the shroud 120 and the outer circumferential surface 120*b* of the shroud 120.

As illustrated in FIG. 2, the acceleration unit 160 may include, for example, first through third sub-acceleration units 160_1 through 160_3. Although the acceleration unit 160 includes three sub-acceleration units in FIG. 2, this is merely for ease of description, and the number of sub-acceleration units included in the acceleration unit 160 is not limited.

The first through third sub-acceleration units 160_1 through 160_3 may be sequentially spaced apart from each other in the first direction DR1.

Figure 5:
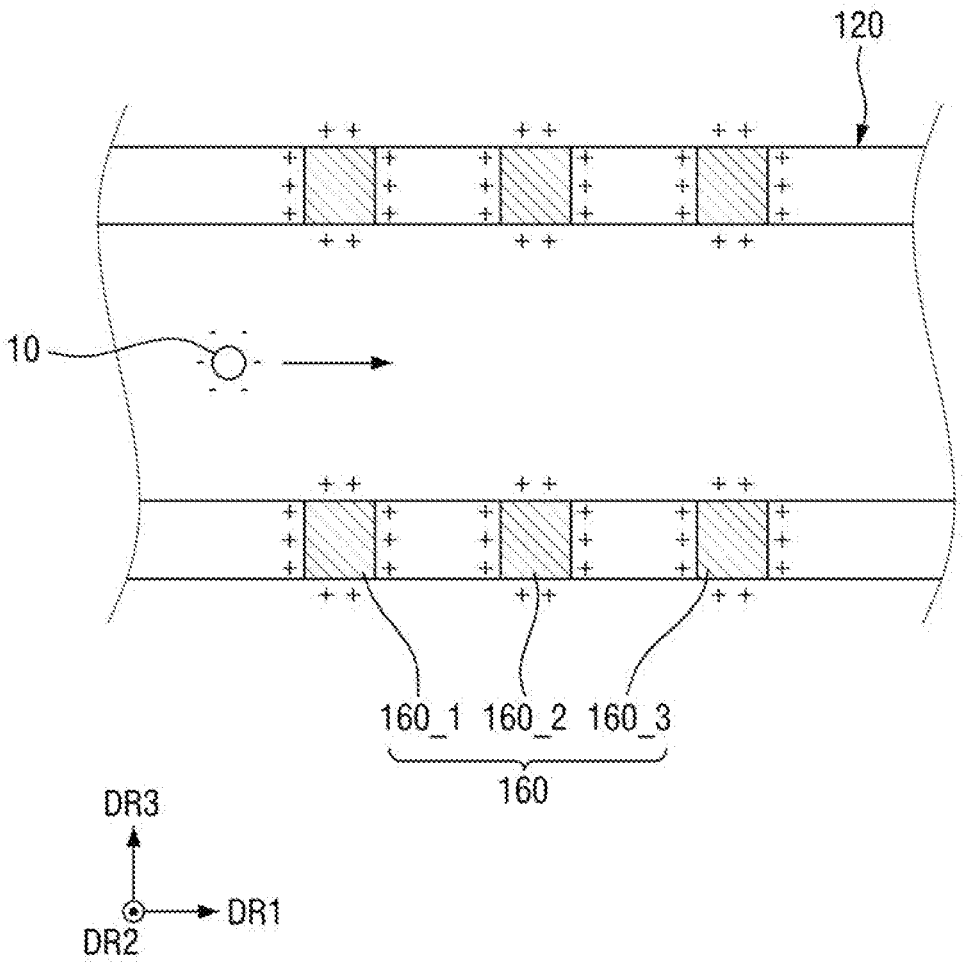
FIG. 5 is a first diagram for explaining an acceleration unit used in the extreme ultraviolet generation apparatus according to the non-limiting example embodiments.

As illustrated in FIG. 5, each of the first through third sub-acceleration units 160_1 through 160_3 may be disposed between the inner circumferential surface 120*a* of the shroud 120 and the outer circumferential surface 120*b* of the shroud 120. However, the present disclosure is not limited thereto.

A part of each of the first through third sub-acceleration units 160_1 through 160_3 may be exposed to the inner circumferential surface 120*a* of the shroud 120. However, the present disclosure is not limited thereto.

Each of the first through third sub-acceleration units 160_1 through 160_3 may include an acceleration electrode. The acceleration unit 160 may accelerate the charged droplet 10 by changing the polarity of each acceleration electrode.

Specifically, the acceleration unit 160 may accelerate the charged droplet 10 by changing the polarity of the acceleration electrode included in each of the first through third sub-acceleration units 160_1 through 160_3 when the charged droplet 10 passes through the inside of the shroud 120 in which the acceleration unit 160 is disposed.

A process in which the charged droplet 10 is accelerated by the acceleration unit 160 will now be described with reference to FIGS. 5 through 8.

Referring to FIG. 5, the charged droplet 10 whose position has been corrected by the alignment unit 150 (see FIG. 2) may enter the first sub-acceleration unit 160_1. In this case, for example, the charged droplet 10 may have a negative charge, and each of the first through third sub-acceleration units 160_1 through 160_3 may be changed to have a positive polarity.

The charged droplet 10 may be accelerated in the first direction DR1 by the attractive force of the first sub-acceleration unit 160_1.

Figure 6:
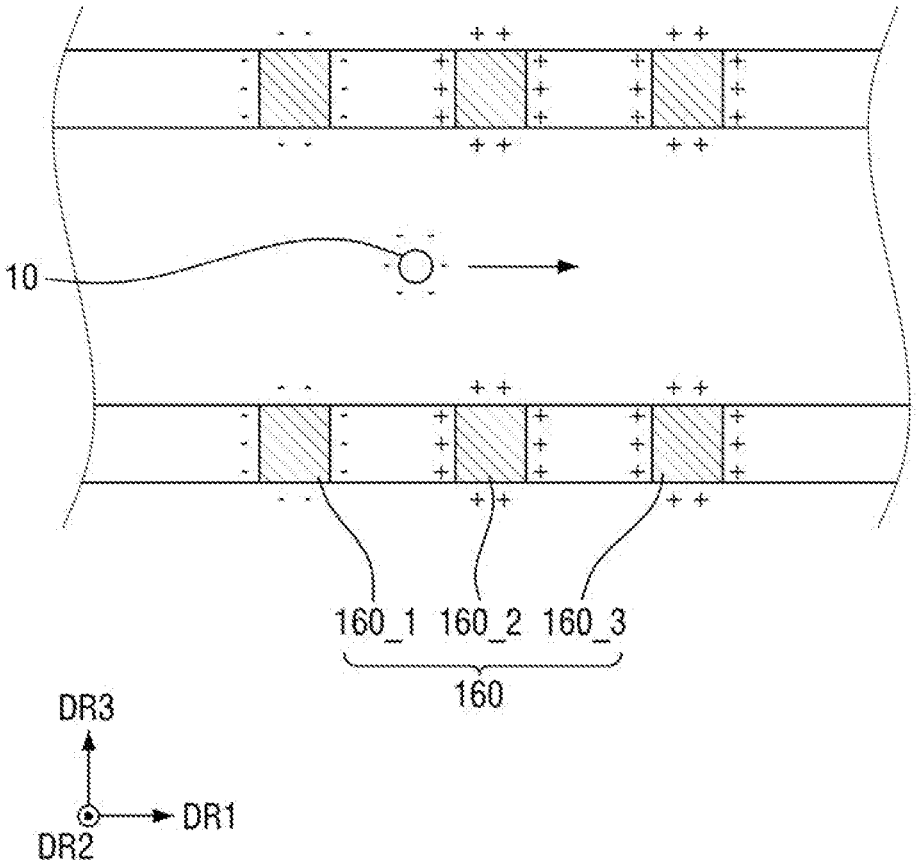
FIG. 6 is a second diagram for explaining the acceleration unit used in the extreme ultraviolet generation apparatus according to the non-limiting example embodiments.

Referring to FIG. 6, when the charged droplet 10 is located between the first sub-acceleration unit 160_1 and the second sub-acceleration unit 160_2, the first sub-acceleration unit 160_1 may be changed to have a negative polarity.

The charged droplet 10 may be accelerated in the first direction DR1 by the repulsive force of the first sub-acceleration unit 160_1 and the attractive force of the second sub-acceleration unit 160_2.

Figure 7:
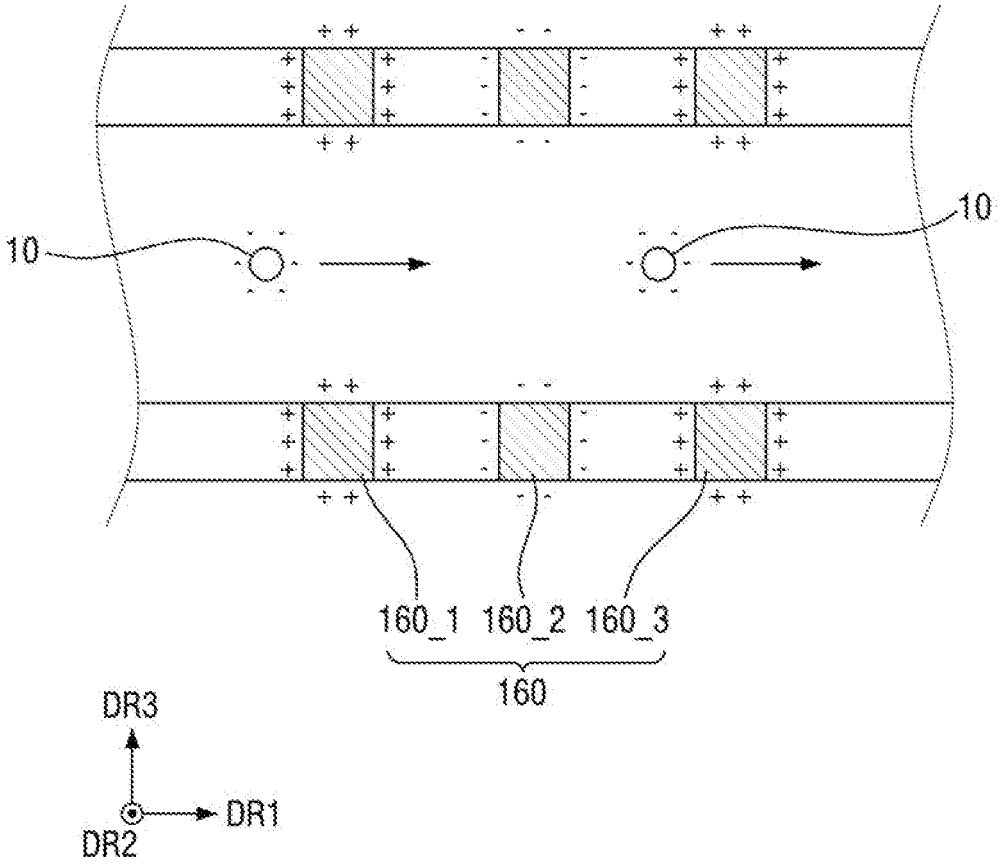
FIG. 7 is a third diagram for explaining the acceleration unit used in the extreme ultraviolet generation apparatus according to the non-limiting example embodiments.

Referring to FIG. 7, when the charged droplet 10 is located between the second sub-acceleration unit 160_2 and the third sub-acceleration unit 160_3, the first sub-acceleration unit 160_1 may be changed to have a positive polarity, and the second sub-acceleration unit 160_2 may be changed to have a negative polarity.

The charged droplet 10 may be accelerated in the first direction DR1 by the repulsive force of the second sub-acceleration unit 160_2 and the attractive force of the third sub-acceleration unit 160_3.

In addition, another charged droplet 10 whose position has been corrected by the alignment unit 150 (see FIG. 2) may enter the first sub-acceleration unit 160_1 and be accelerated in the first direction DR1.

Figure 8:
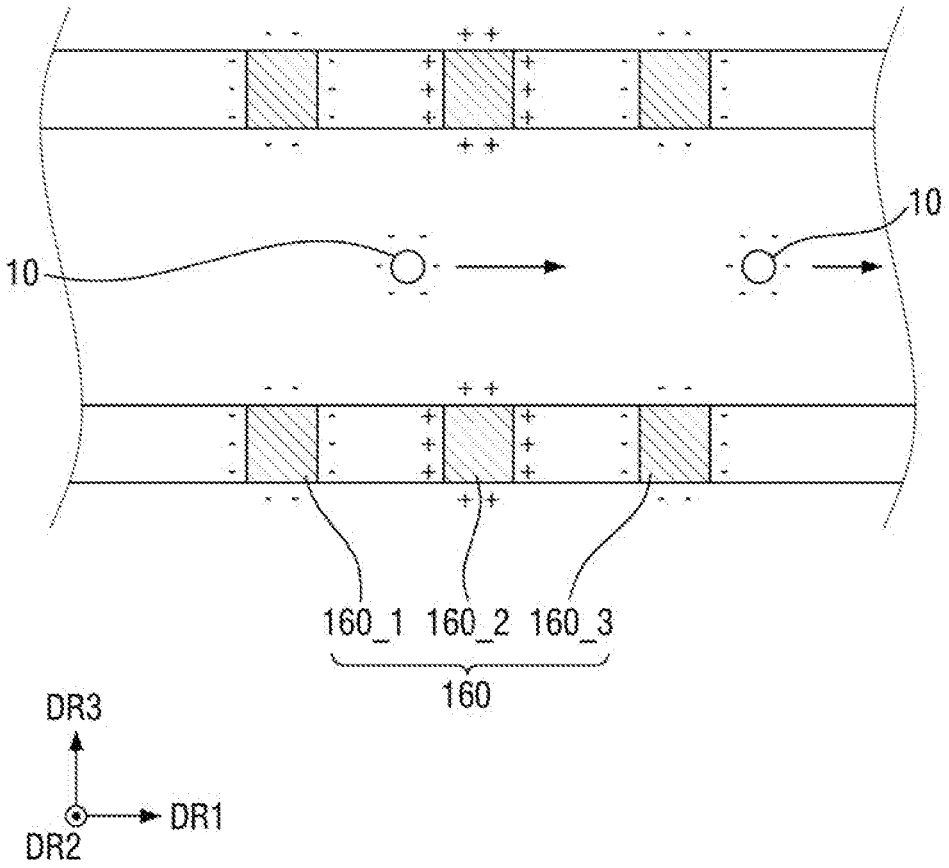
FIG. 8 is a fourth diagram for explaining the acceleration unit used in the extreme ultraviolet generation apparatus according to the non-limiting example embodiments.

Referring to FIG. 8, when the charged droplet 10 passes through the third sub-acceleration unit 160_3, the first sub-acceleration unit 160_1 may be changed to have a negative polarity, the second sub-acceleration unit 160_2 may be changed to have a positive polarity, and the third sub-acceleration unit 160_3 may be changed to have a negative polarity.

The charged droplet 10 passing through the third sub-acceleration unit 160_3 may be accelerated in the first direction DR1 by the repulsive force of the third sub-acceleration unit 160_3. In addition, the charged droplet 10 located between the first sub-acceleration unit 160_1 and the second sub-acceleration unit 160_2 may also be accelerated in the first direction DR1.

The operation of the extreme ultraviolet generation apparatus according to non-limiting example embodiments will now be described with reference to FIGS. 1 through 4 and FIG. 9.

Figure 9:
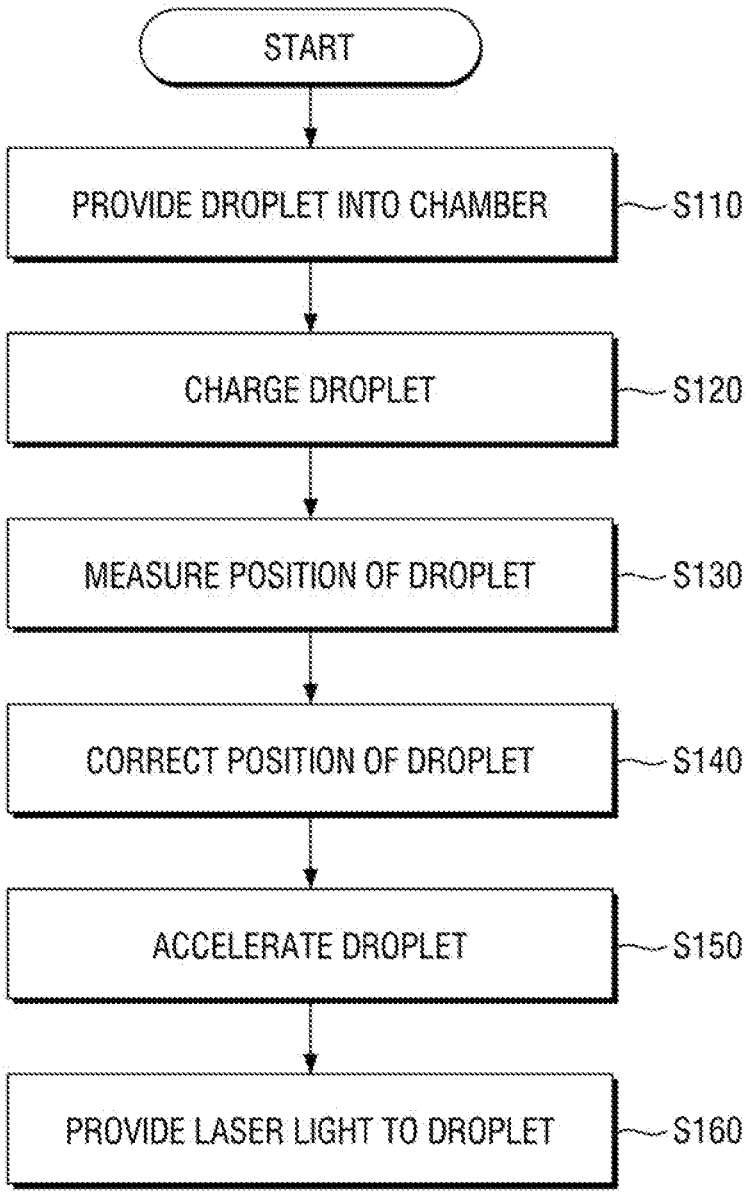
FIG. 9 is a flowchart illustrating the operation of the extreme ultraviolet generation apparatus according to the non-limiting example embodiments.

FIG. 9 is a flowchart illustrating the operation of the extreme ultraviolet generation apparatus according to non-limiting example embodiments.

Referring to FIGS. 1 through 4 and FIG. 9, a droplet 10 may be provided into the chamber 100 (operation S110). Specifically, the droplet generator 110 may provide the droplet 10 which is a raw material for generating extreme ultraviolet light into the chamber 100 in the first direction DR1.

Next, the charging unit 130 may charge the droplet 10 (operation S120). In this case, the droplet 10 may be, for example, negatively charged.

Next, the monitoring unit 140 may measure the position of the charged droplet 10 (operation S130). Specifically, the monitoring unit 140 may measure the position of the charged droplet 10 by sensing a change in an electric field E formed by the first through fourth monitoring electrodes 140_1 through 140_4.

Next, the alignment unit 150 may correct the position of the charged droplet 10 (operation S140). Specifically, the alignment unit 150 may correct the position of the charged droplet 10 using a magnetic field M formed by the first through fourth electromagnets 150_1 through 150_4.

Next, the acceleration unit 160 may accelerate the charged droplet 10 (operation S150). Specifically, the acceleration unit 160 may accelerate the charged droplet 10 in the first direction DR1 by using the acceleration electrode included in each of the first through third sub-acceleration units 160_1 through 160_3.

Next, the light source 180 may provide laser light to the charged droplet 10 (operation S160). Specifically, the charged droplet 10 may be discharged out of the shroud 120 and reach the first position P1 inside the chamber 100. The charged droplet 10 reaching the first position P1 may be pretreated with the first laser light L1 provided from the light source 180. Then, the charged droplet 10 may reach the second position P2 inside the chamber 100. The charged droplet 10 reaching the second position P2 may generate plasma in response to the second laser light L2 provided from the light source 180. In this case, extreme ultraviolet light may be generated from the plasma.

The extreme ultraviolet light generated from the plasma may be reflected by the reflection unit 170 and concentrated at the third position P3 inside the chamber 100.

The extreme ultraviolet generation apparatus according to non-limiting example embodiments may accelerate droplets, including a plurality of droplet 10, using the acceleration unit 160, thereby improving the delivery frequency of the droplets, including the plurality of droplet 10, while maintaining an interval between the droplets. In addition, the extreme ultraviolet generation apparatus according to non-limiting example embodiments may improve the accuracy of delivering a droplet 10 by measuring the position of the droplet 10 using the monitoring unit 140 and correcting the position of the droplet 10 using the alignment unit 150.

In the extreme ultraviolet generation apparatus according to non-limiting example embodiments, the charging unit 130, the monitoring unit 140, the alignment unit 150 and the acceleration unit 160 which are components for accelerating a droplet 10 are disposed in the shroud 120 to improve the degree of integration of extreme ultraviolet light by minimizing the interference generated in the process of integrating the extreme ultraviolet light.

An extreme ultraviolet generation apparatus according to non-limiting example embodiments will now be described with reference to FIGS. 10 through 12. The following description will focus on differences from the extreme ultraviolet generation apparatus illustrated in FIGS. 1 through 8.

Figure 10:
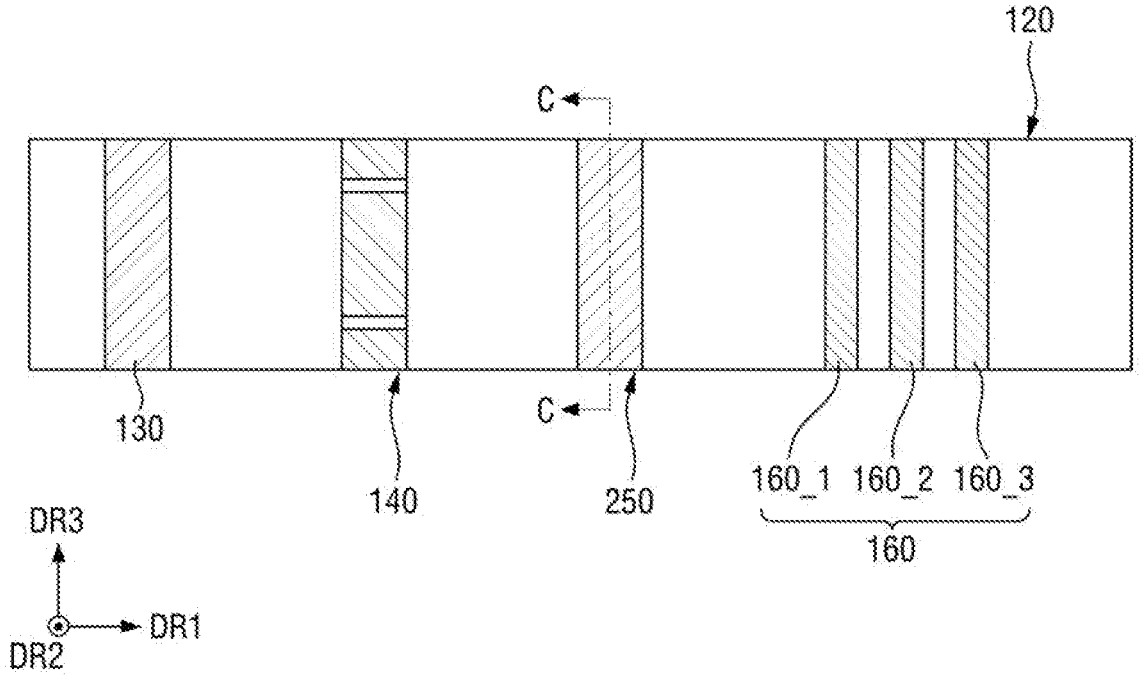
FIG. 10 illustrates a shroud used in an extreme ultraviolet generation apparatus according to non-limiting example embodiments.

FIG. 10 illustrates a shroud 120 used in an extreme ultraviolet generation apparatus according to non-limiting example embodiments. FIG. 11 is a cross-sectional view taken along line C-C of FIG. 10. FIG. 12 is a view for explaining the operation of an alignment unit 250 illustrated in FIG. 11.

Figure 11:
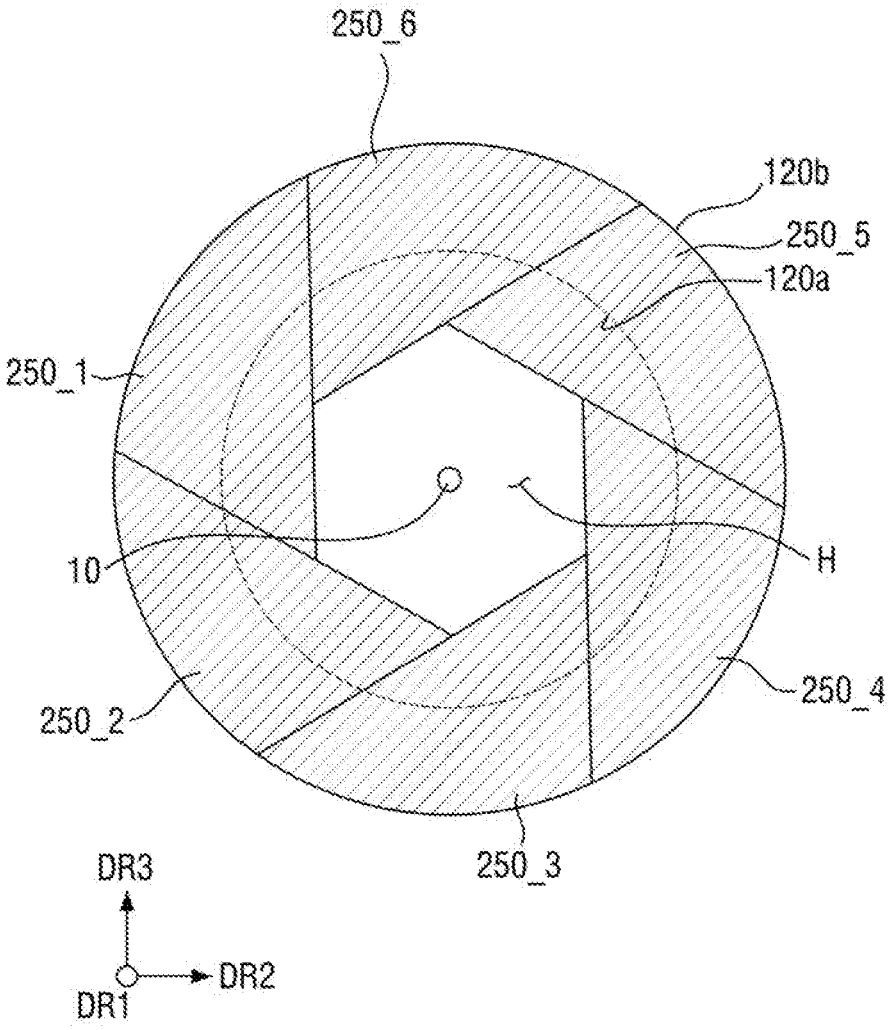
FIG. 11 is a cross-sectional view taken along line C-C of FIG. 10.

Referring to FIGS. 10 and 11, in the extreme ultraviolet generation apparatus according to non-limiting example embodiments, the alignment unit 250 may include a plurality of electromagnets protruding from an inner circumferential surface 120*a* of the shroud 120 along the inner circumferential surface 120*a* of the shroud 120.

The alignment unit 250 may include first through sixth electromagnets 250_1 through 250_6. Each of the first through sixth electromagnets 250_1 through 250_6 may protrude from the inner circumferential surface 120*a* of the shroud 120.

Although an outer circumferential surface of each of the first through sixth electromagnets 250_1 through 250_6 is formed in the same line as an outer circumferential surface 120*b* of the shroud 120 in FIG. 11, the present disclosure is not limited thereto. That is, in non-limiting example embodiments, the outer circumferential surface of each of the first through sixth electromagnets 250_1 through 250_6 may protrude from the outer circumferential surface 120*b* of the shroud 120.

The first through sixth electromagnets 250_1 through 250_6 may at least partially overlap each other.

Specifically, a part of the first electromagnet 250_1 may overlap the second electromagnet 250_2, and another part of the first electromagnet 250_1 may overlap the sixth electromagnet 250_6. A part of the second electromagnet 250_2 may overlap the third electromagnet 250_3, and another part of the second electromagnet 250_2 may overlap the first electromagnet 250_1. A part of the third electromagnet 250_3 may overlap the fourth electromagnet 250_4, and another part of the third electromagnet 250_3 may overlap the second electromagnet 250_2. A part of the fourth electromagnet 250_4 may overlap the fifth electromagnet 250_5, and another part of the fourth electromagnet 250_4 may overlap the third electromagnet 250_3. A part of the fifth electromagnet 250_5 may overlap the sixth electromagnet 250_6, and another part of the fifth electromagnet 250_5 may overlap the fourth electromagnet 250_4. A part of the sixth electromagnet 250_6 may overlap the first electromagnet 250_1, and another part of the sixth electromagnet 250_6 may overlap the fifth electromagnet 250_5.

A droplet passage hole H defined between the first through sixth electromagnets 250_1 through 250_6 may be formed inside the shroud 120. A cross-sectional shape of the droplet passage hole H may be, for example, a hexagonal shape. However, in non-limiting example embodiments, the cross-sectional shape of the droplet passage hole H may vary depending on the number of electromagnets included in the alignment unit 250.

Figure 12:
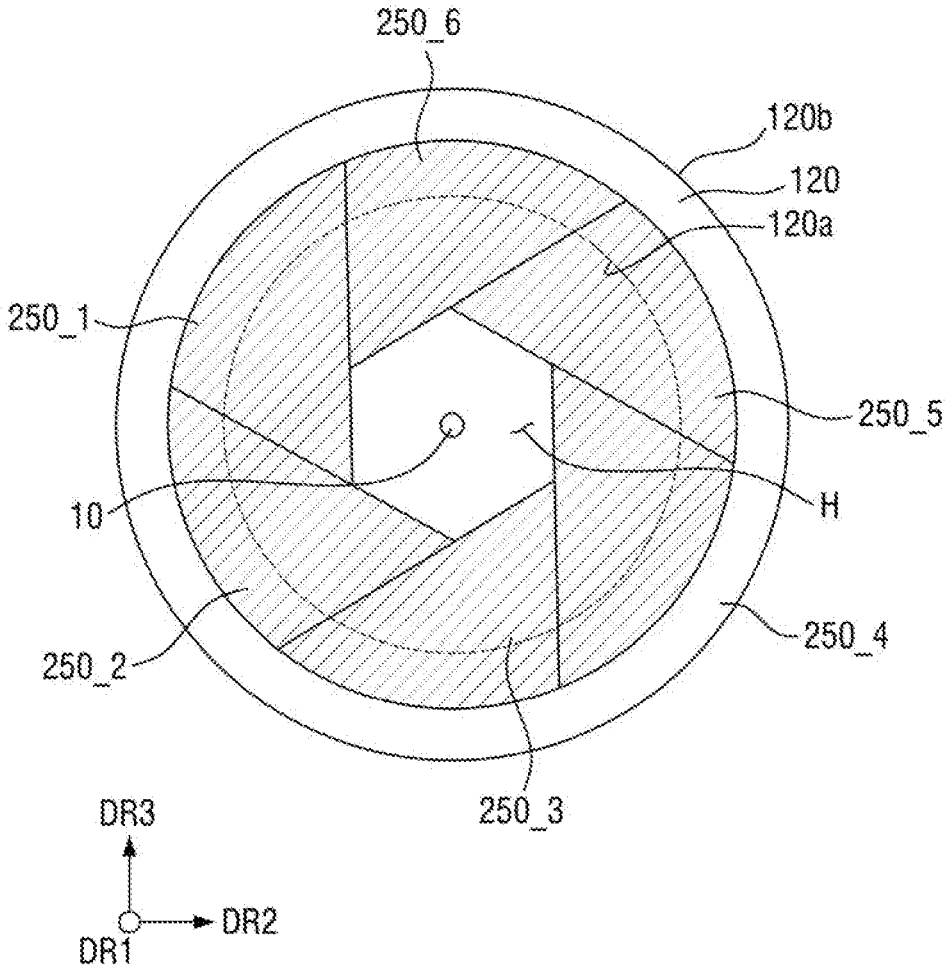
FIG. 12 is a view for explaining the operation of an alignment unit illustrated in FIG. 11.

Referring to FIG. 12, the alignment unit 250 may correct the position of a droplet 10 by adjusting a width of the droplet passage hole H.

Specifically, each of the first through sixth electromagnets 250_1 through 250_6 included in the alignment unit 250 may be moved into the shroud 120. Therefore, the width of the droplet passage hole H may be reduced. The reduced width of the droplet passage hole H may relatively increase the intensity of a magnetic field formed between the first through sixth electromagnets 250_1 through 250_6.

An extreme ultraviolet generation apparatus according to non-limiting example embodiments will now be described with reference to FIGS. 13 and 14. The following description will focus on differences from the extreme ultraviolet generation apparatus illustrated in FIGS. 1 through 8.

Figure 13:
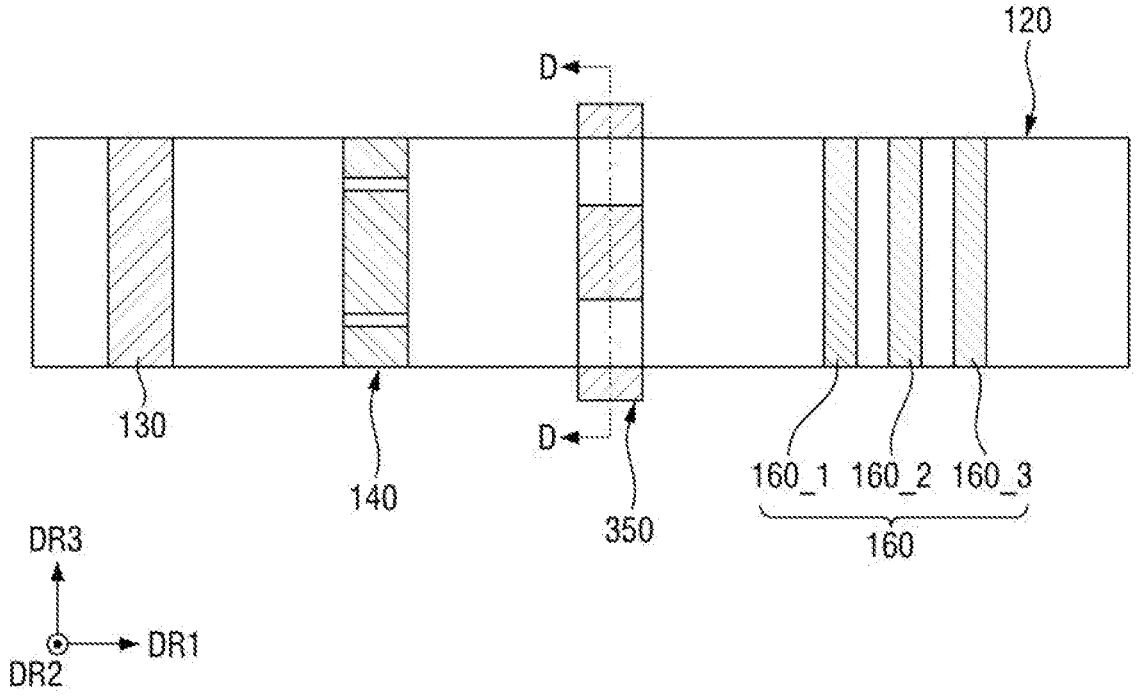
FIG. 13 illustrates a shroud used in an extreme ultraviolet generation apparatus according to non-limiting example embodiments.

FIG. 13 illustrates a shroud 120 used in an extreme ultraviolet generation apparatus according to non-limiting example embodiments. FIG. 14 is a cross-sectional view taken along line D-D of FIG. 13.

Figure 14:
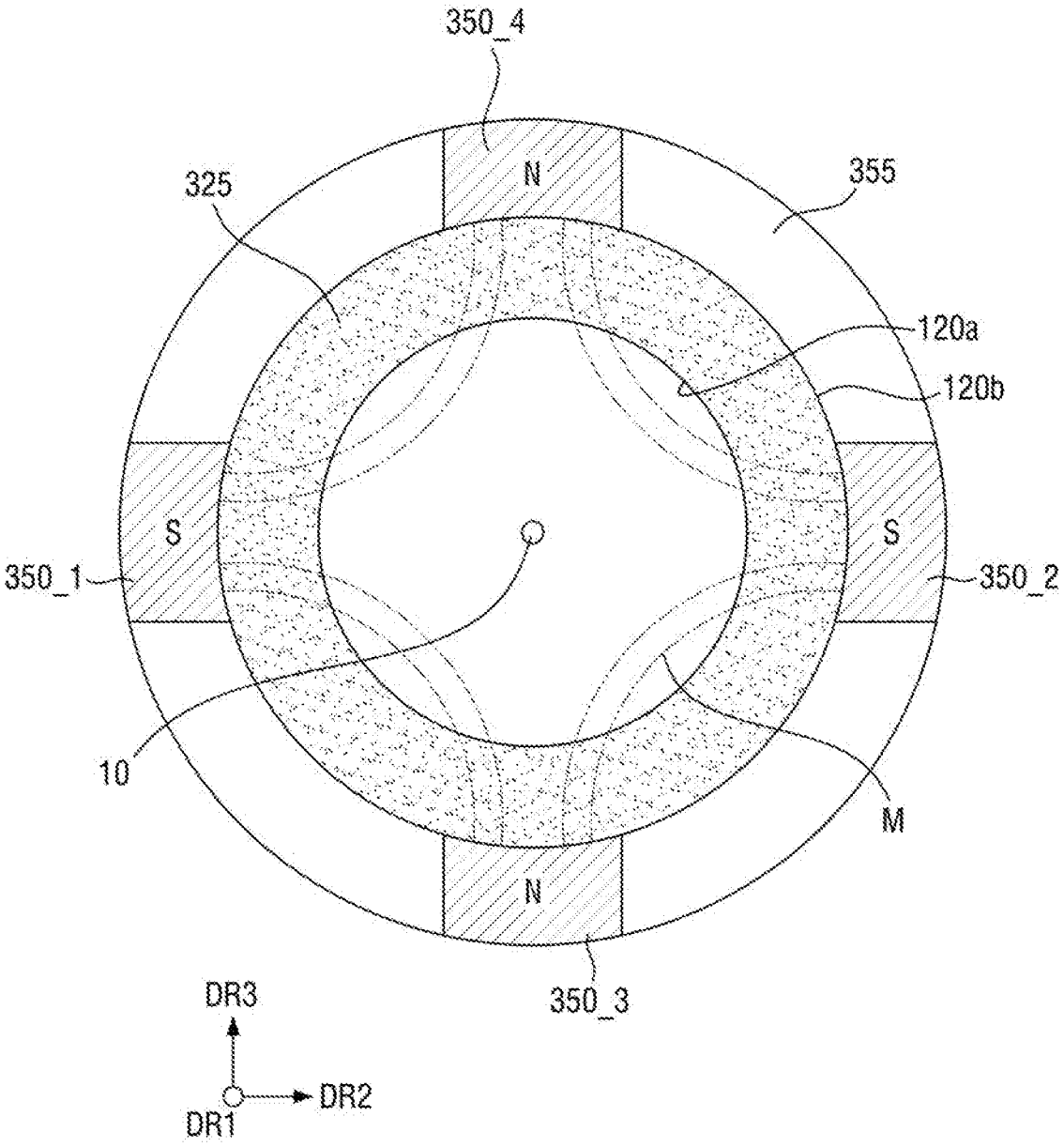
FIG. 14 is a cross-sectional view taken along line D-D of FIG. 13.

Referring to FIGS. 13 and 14, in the extreme ultraviolet generation apparatus according to non-limiting example embodiments, an alignment unit 350 may surround an outer circumferential surface 120*b* of the shroud 120. The alignment unit 350 may contact the outer circumferential surface 120*b* of the shroud 120.

The alignment unit 350 may include first through fourth electromagnets 350_1 through 350_4 and an electromagnet connecting part 355.

The first through fourth electromagnets 350_1 through 350_4 may be spaced apart from each other. Specifically, the first electromagnet 350_1 may be spaced apart from the second electromagnet 350_2 in the second direction DR2. The third electromagnet 350_3 may be spaced apart from the fourth electromagnet 350_4 in the third direction DR3.

The electromagnet connecting part 355 may be disposed between the first electromagnet 350_1 and the third electromagnet 350_3, between the third electromagnet 350_3 and the second electromagnet 350_2, between the second electromagnet 350_2 and the fourth electromagnet 350_4, and between the fourth electromagnet 350_4 and the first electromagnet 350_1.

A magnetic field transmitting part 325 may be disposed in the shroud 120. The magnetic field transmitting part 325 may be disposed between an inner circumferential surface 120*a* of the shroud 120 and the outer circumferential surface 120*b* of the shroud 120.

The magnetic field transmitting part 325 may overlap the alignment unit 350. The magnetic field transmitting part 325 may contact the first through fourth electromagnets 350_1 through 350_4 and the electromagnet connecting part 355.

The magnetic field transmitting part 325 may transmit a magnetic field M formed by each of the first through fourth electromagnets 350_1 through 350_4. The magnetic field transmitting part 325 may include, for example, a metal. However, in non-limiting example embodiments, the magnetic field transmitting part 325 may include a non-metal material that transmits the magnetic field M.

An extreme ultraviolet generation apparatus according to non-limiting example embodiments will now be described with reference to FIGS. 15 and 16. The following description will focus on differences from the extreme ultraviolet generation apparatus illustrated in FIGS. 1 through 8.

Figure 15:
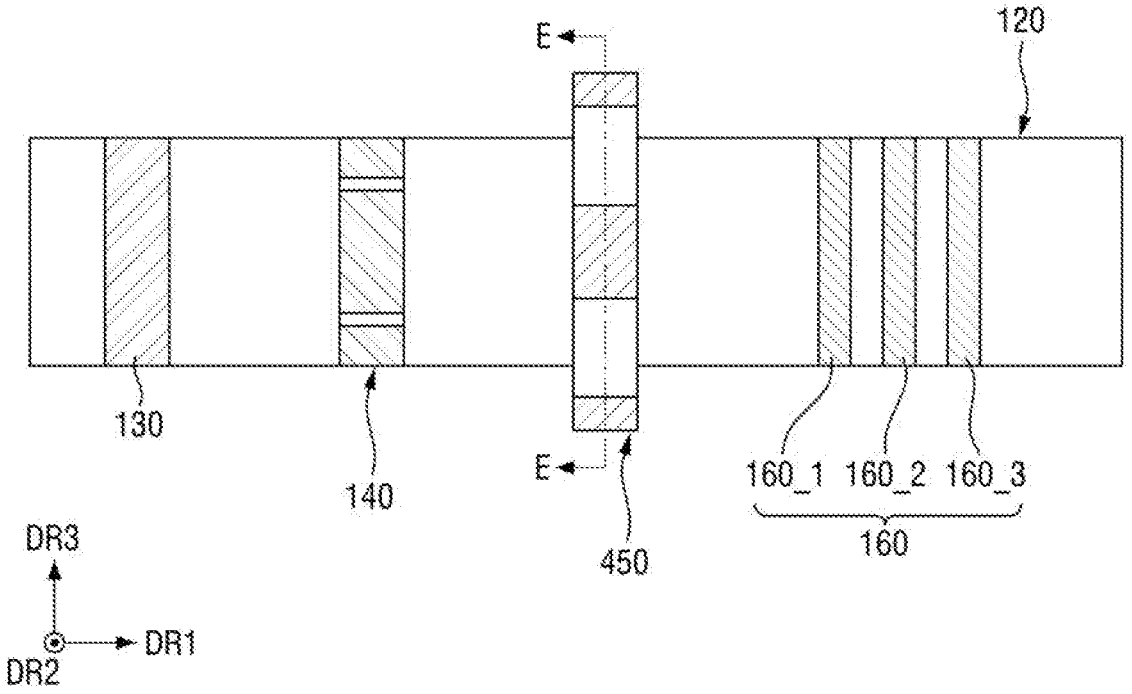
FIG. 15 illustrates a shroud used in an extreme ultraviolet generation apparatus according to non-limiting example embodiments.

FIG. 15 illustrates a shroud 120 used in an extreme ultraviolet generation apparatus according to non-limiting example embodiments. FIG. 16 is a cross-sectional view taken along line E-E of FIG. 15.

Figure 16:
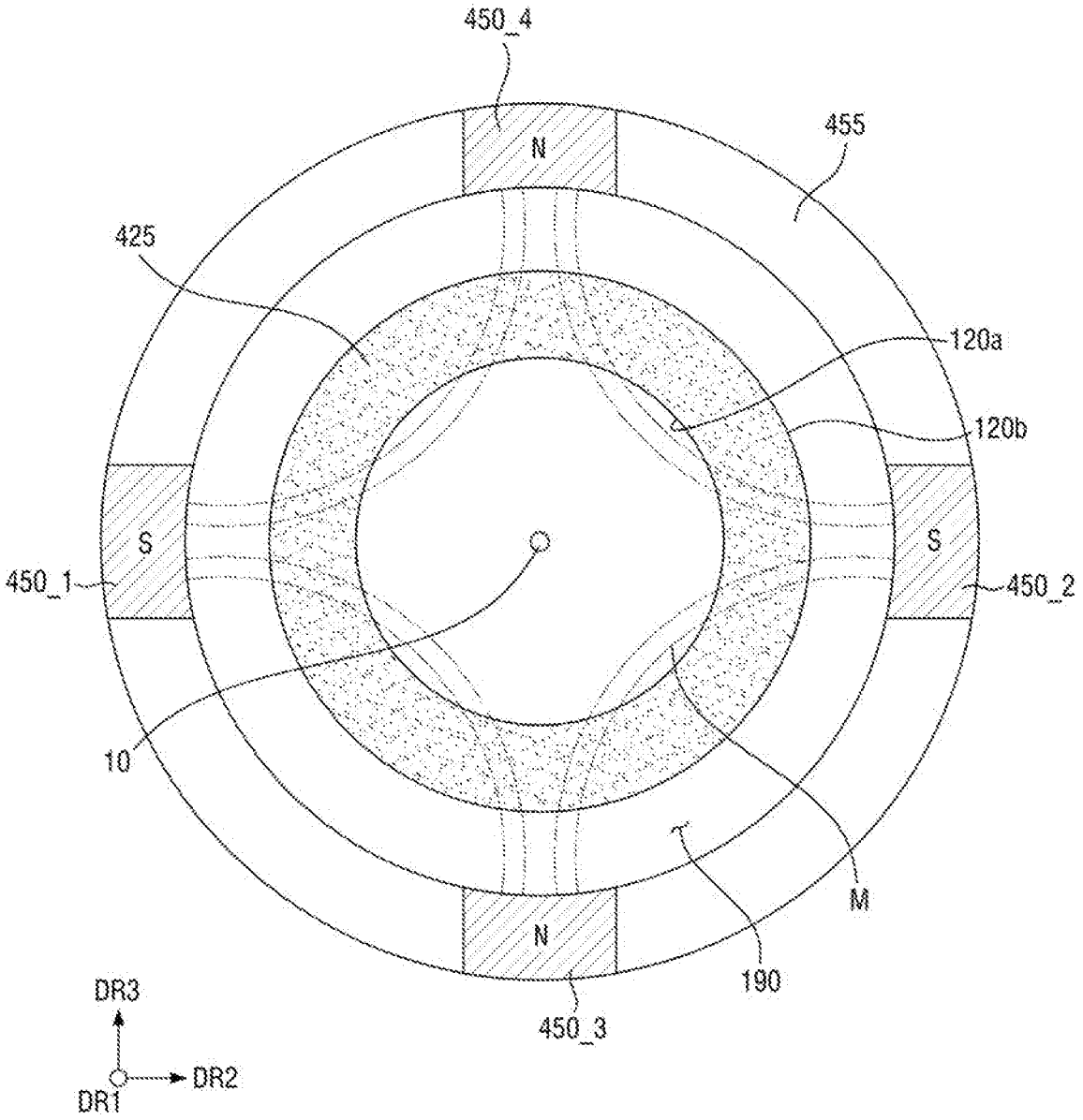
FIG. 16 is a cross-sectional view taken along line E-E of FIG. 15.

Referring to FIGS. 15 and 16, in the extreme ultraviolet generation apparatus according to non-limiting example embodiments, an alignment unit 450 may surround an outer circumferential surface 120*b* of the shroud 120. The alignment unit 450 may be spaced apart from the outer circumferential surface 120*b* of the shroud 120.

The alignment unit 450 may include first through fourth electromagnets 450_1 through 450_4 and an electromagnet connecting part 455.

The first through fourth electromagnets 450_1 through 450_4 may be spaced apart from each other. Specifically, the first electromagnet 450_1 may be spaced apart from the second electromagnet 450_2 in the second direction DR2, and the third electromagnet 450_3 may be spaced apart from the fourth electromagnet 450_4 in the third direction DR3.

The electromagnet connecting part 455 may be disposed between the first electromagnet 450_1 and the third electromagnet 450_3, between the third electromagnet 450_3 and the second electromagnet 450_2, between the second electromagnet 450_2 and the fourth electromagnet 450_4, and between the fourth electromagnet 450_4 and the first electromagnet 450_1.

A magnetic field transmitting part 425 may be disposed in the shroud 120. The magnetic field transmitting part 425 may be disposed between an inner circumferential surface 120*a* of the shroud 120 and the outer circumferential surface 120*b* of the shroud 120.

The magnetic field transmitting part 425 may overlap the alignment unit 450. The magnetic field transmitting part 425 may be spaced apart from the first through fourth electromagnets 450_1 through 450_4 and the electromagnet connecting part 455. That is, a space 190 may be formed between the magnetic field transmitting part 425 and the alignment unit 450.

The magnetic field transmitting part 425 may be connected to a chamber 100. The magnetic field transmitting part 425 may be moved in the second direction DR2 and the third direction DR3. The extreme ultraviolet generation apparatus according to non-limiting example embodiments may adjust a magnetic field M generated inside the shroud 120 by moving the magnetic field transmitting part 425.

The magnetic field transmitting part 425 may transmit the magnetic field M formed by each of the first through fourth electromagnets 450_1 through 450_4. The magnetic field transmitting part 425 may include, for example, a metal. However, in non-limiting example embodiments, the magnetic field transmitting part 425 may include a non-metal material that transmits the magnetic field M.

An extreme ultraviolet generation apparatus according to non-limiting example embodiments will now be described with reference to FIG. 17. The following description will focus on differences from the extreme ultraviolet generation apparatus illustrated in FIGS. 1 through 8.

Figure 17:
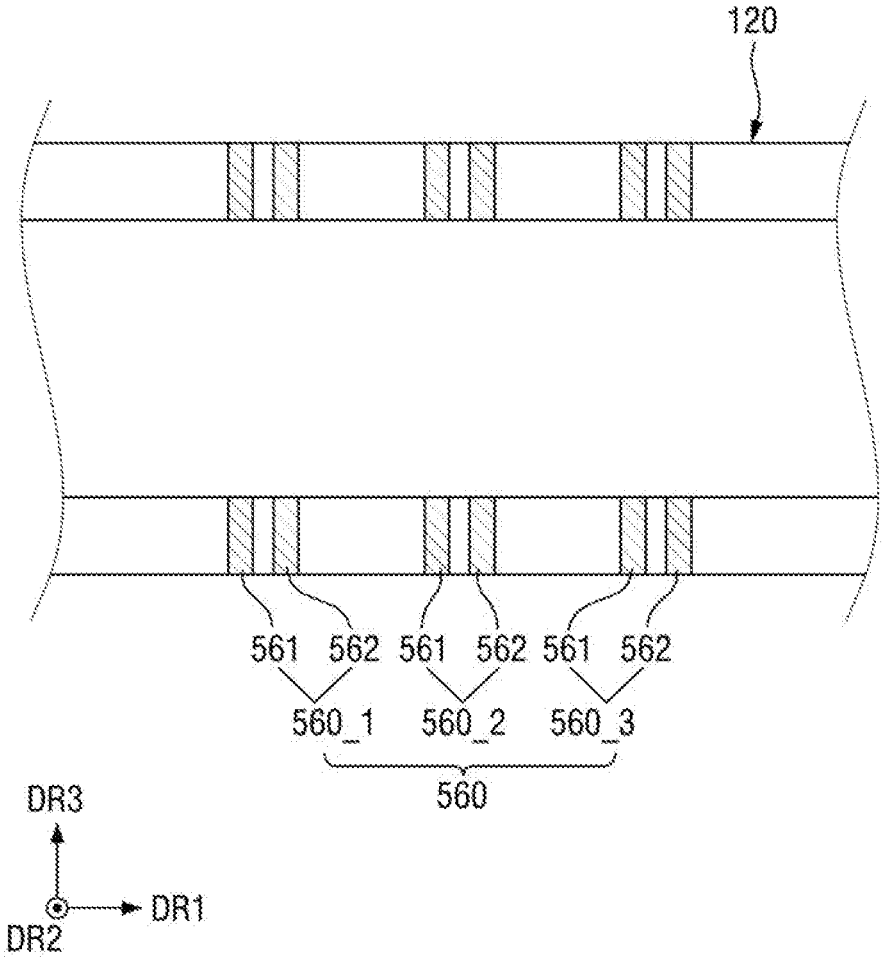
FIG. 17 illustrates an acceleration unit used in an extreme ultraviolet generation apparatus according to non-limiting example embodiments.

FIG. 17 illustrates an acceleration unit used in an extreme ultraviolet generation apparatus according to non-limiting example embodiments.

Referring to FIG. 17, in the extreme ultraviolet generation apparatus according to non-limiting example embodiments, each of first through third sub-acceleration units 560_1 through 560_3 of the acceleration unit 560 may include a first acceleration electrode 561 and a second acceleration electrode 562.

The first acceleration electrode 561 and the second acceleration electrode 562 may be spaced apart from each other in the first direction DR1. A shroud 120 may be disposed between the first acceleration electrode 561 and the second acceleration electrode 562.

An extreme ultraviolet generation apparatus according to non-limiting example embodiments will now be described with reference to FIG. 18. The following description will focus on differences from the extreme ultraviolet generation apparatus illustrated in FIGS. 1 through 8.

Figure 18:
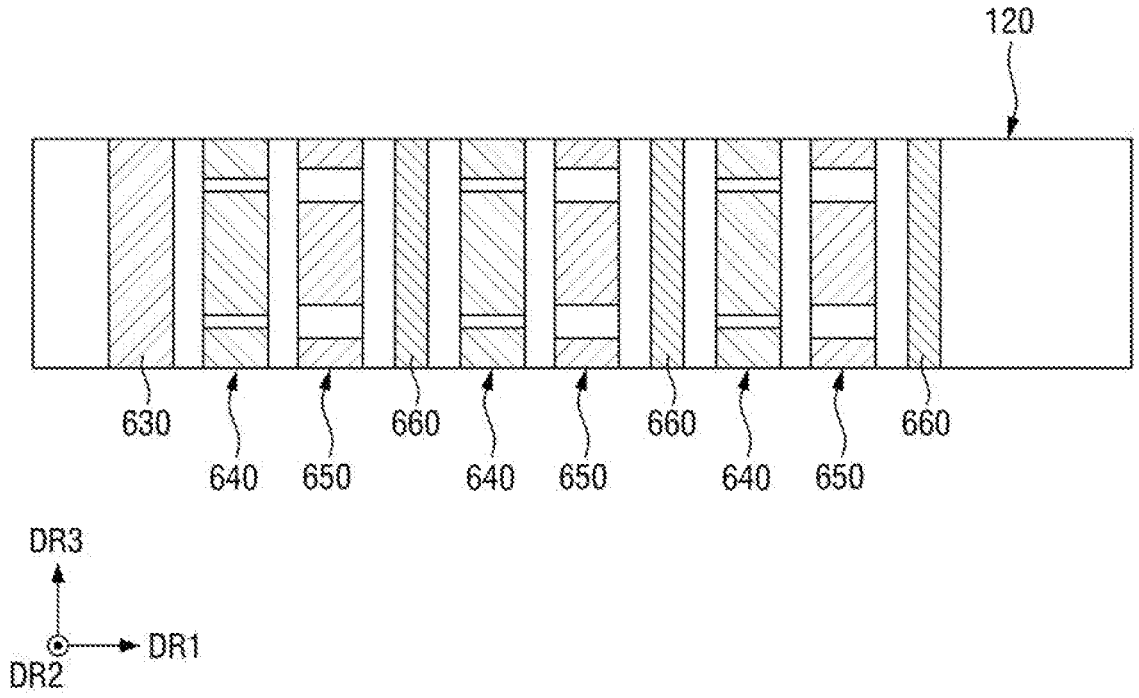
FIG. 18 illustrates a shroud used in an extreme ultraviolet generation apparatus according to non-limiting example embodiments.

FIG. 18 illustrates a shroud 120 used in an extreme ultraviolet generation apparatus according to non-limiting example embodiments.

Referring to FIG. 18, a monitoring unit 640, an alignment unit 650, and an acceleration unit 660 may be repeatedly disposed in the shroud 120.

Specifically, a charging unit 630, a monitoring unit 640, an alignment unit 650, an acceleration unit 660, a monitoring unit 640, an alignment unit 650, an acceleration unit 660, a monitoring unit 640, an alignment unit 650, and an acceleration unit 660 may be sequentially disposed in this order in the shroud 120 and spaced apart from each other in the first direction DR1. Each acceleration unit 660 may include one acceleration electrode.

An extreme ultraviolet generation apparatus according to non-limiting example embodiments will now be described with reference to FIG. 19. The following description will focus on differences from the extreme ultraviolet generation apparatus illustrated in FIGS. 1 through 8.

Figure 19:
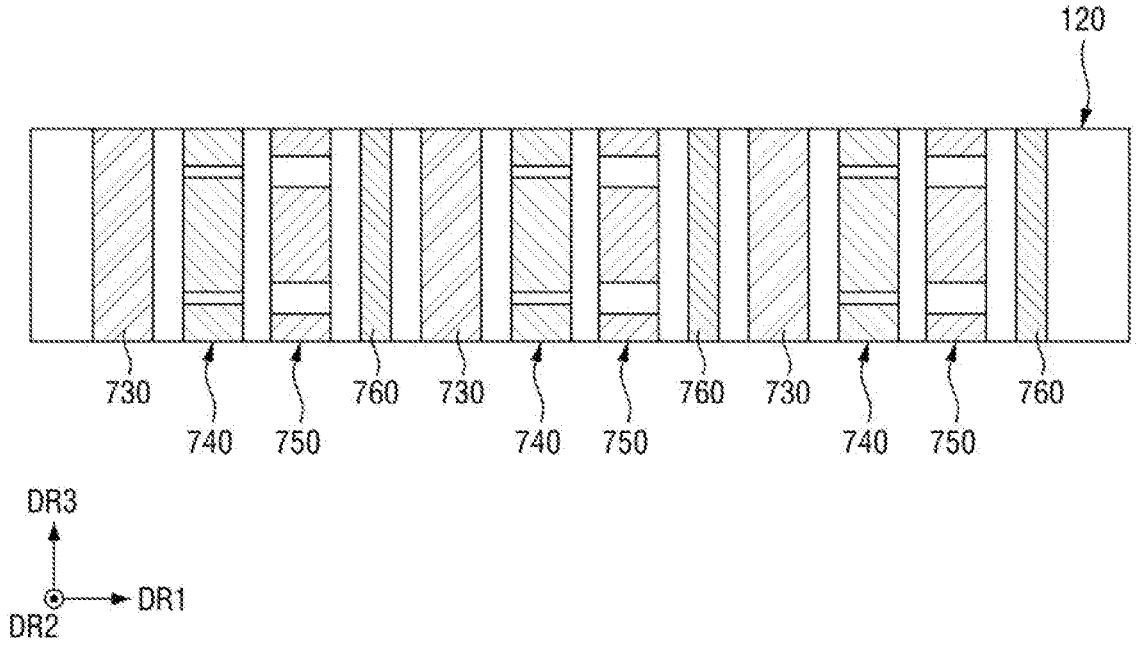
FIG. 19 illustrates a shroud used in an extreme ultraviolet generation apparatus according to non-limiting example embodiments.

FIG. 19 illustrates a shroud 120 used in an extreme ultraviolet generation apparatus according to non-limiting example embodiments.

Referring to FIG. 19, a charging unit 730, a monitoring unit 740, an alignment unit 750, and an acceleration unit 760 may be repeatedly disposed in the shroud 120.

Specifically, a charging unit 730, a monitoring unit 740, an alignment unit 750, an acceleration unit 760, a charging unit 730, a monitoring unit 740, an alignment unit 750, an acceleration unit 760, a charging unit 730, a monitoring unit 740, an alignment unit 750, and an acceleration unit 760 may be sequentially disposed in this order in the shroud 120 and spaced apart from each other in the first direction DR1. Each acceleration unit 760 may include one acceleration electrode.

In non-limiting example embodiments, the extreme ultraviolet generation apparatuses may comprise a controller comprising at least one processor and memory including computer instructions. The computer instructions, when executed by the at least one processor, may be configured to cause any number of the droplet generators, the charging units, the monitoring units, the alignment units, the acceleration units, and the light sources of the present disclosure to perform their respective functions.

While the present disclosure has been particularly shown and described with reference to non-limiting example embodiments thereof, it will be understood by those of ordinary skill in the art that various changes in form and detail may be made therein without departing from the spirit and scope of the present disclosure as defined by the following claims. The non-limiting example embodiments should be considered in a descriptive sense only and not for purposes of limitation.

What is claimed is:

1. An extreme ultraviolet generation apparatus comprising:

a chamber;

a droplet generator configured to provide a droplet into the chamber;

a shroud which extends along a movement path of the droplet inside the chamber and surrounds the movement path of the droplet;

a charging unit configured to charge the droplet;

a monitoring unit configured to measure a position of the charged droplet;

an alignment unit comprising at least one electromagnet, the alignment unit configured to correct the position of the charged droplet within the shroud using the at least one electromagnet; and an acceleration unit configured to accelerate the charged droplet after the position of the charged droplet has been corrected.

2. The apparatus of claim 1, wherein the monitoring unit is configured to measure the position of the charged droplet using an electric field.

3. The apparatus of claim 1, wherein the charging unit, the monitoring unit, the alignment unit, and the acceleration unit are sequentially disposed in the shroud along the movement path of the droplet.

4. The apparatus of claim 1, wherein the alignment unit is disposed between an outer circumferential surface of the shroud and an inner circumferential surface of the shroud.

5. The apparatus of claim 1, wherein the alignment unit surrounds the shroud and contacts an outer circumferential surface of the shroud.

6. The apparatus of claim 1, wherein the alignment unit surrounds the shroud and is spaced apart from an outer circumferential surface of the shroud.

7. The apparatus of claim 6, wherein the shroud comprises a magnetic field transmitting part disposed so as to face the alignment unit, and the magnetic field transmitting part comprises a metal.

8. The apparatus of claim 1, wherein the at least one electromagnet protrudes from an inner circumferential surface of the shroud along the inner circumferential surface of the shroud, and the alignment unit is configured to correct the position of the charged droplet by adjusting a width of a droplet passage hole formed between the at least one electromagnet inside the shroud.

9. The apparatus of claim 1, wherein the acceleration unit comprises first and second sub-acceleration units spaced apart from each other, and each of the first and second sub-acceleration units comprises at least one acceleration electrode.

10. The apparatus of claim 9, wherein each of the first and second sub-acceleration units comprises, as the at least one acceleration electrode, a first acceleration electrode and a second acceleration electrode spaced apart from each other.

11. The apparatus of claim 1, further comprising a light source which is configured to pretreat the charged droplet by providing a first laser light to the charged droplet reaching a first position inside the chamber and further configured to generate a plasma by providing a second laser light to the charged droplet reaching a second position farther away from the droplet generator than the first position.

12. The apparatus of claim 11, further comprising a reflection unit which is disposed in the chamber and configured to integrate an extreme ultraviolet light generated from the plasma by reflecting the extreme ultraviolet light.

13. An extreme ultraviolet generation apparatus comprising:

a chamber;

a droplet generator configured to provide a droplet into the chamber;

a shroud which extends along a movement path of the droplet inside the chamber and surrounds the movement path of the droplet;

a charging unit which is disposed in the shroud and configured to charge the droplet;

an alignment unit comprising at least one electromagnet exposed to an inner circumferential surface of the shroud, the alignment unit disposed in the shroud and configured to correct a position of the charged droplet using the at least one electromagnet; and a light source configured to provide a laser light to the charged droplet.

14. The apparatus of claim 13, further comprising:

a monitoring unit configured to measure the position of the droplet charged by the charging unit; and an acceleration unit configured to accelerate the charged droplet after the position of the charged droplet has been corrected by the alignment unit.

15. The apparatus of claim 14, wherein the acceleration unit is configured to accelerate the charged droplet by changing a polarity of an acceleration electrode of the acceleration unit.

16. The apparatus of claim 13, wherein the alignment unit is disposed between an outer circumferential surface of the shroud and the inner circumferential surface of the shroud.

17. The apparatus of claim 13, wherein the at least one electromagnet protrudes from the inner circumferential surface of the shroud along the inner circumferential surface of the shroud, and the alignment unit is configured to correct the position of the charged droplet by adjusting a width of a droplet passage hole formed between the at least one electromagnet inside the shroud.

18. The apparatus of claim 13, wherein the light source is configured to pretreat the charged droplet by providing a first laser light to the charged droplet reaching a first position inside the chamber and further configured to generate a plasma by providing a second laser light to the charged droplet reaching a second position farther away from the droplet generator than the first position.

19. An extreme ultraviolet generation apparatus comprising:

a chamber;

a droplet generator configured to provide a droplet into the chamber;

a shroud which extends along a movement path of the droplet inside the chamber and surrounds the movement path of the droplet;

a charging unit configured to charge the droplet;

a monitoring unit configured to measure a position of the charged droplet using an electric field;

an alignment unit comprising at least one electromagnet, the alignment unit disposed between an outer circumferential surface of the shroud and an inner circumferential surface of the shroud and configured to correct the position of the charged droplet using the at least one electromagnet;

an acceleration unit comprising an acceleration electrode, the acceleration unit configured to accelerate the charged droplet, after the position of the charged droplet has been corrected, using the acceleration electrode; and a light source configured to pretreat the charged droplet by providing a first laser light to the charged droplet reaching a first position inside the chamber and further configured to generate a plasma by providing a second laser light to the charged droplet reaching a second position farther away from the droplet generator than the first position, wherein the charging unit, the monitoring unit, the alignment unit, and the acceleration unit are sequentially disposed in the shroud along the movement path of the droplet.

20. The apparatus of claim 19, further comprising a reflection unit which is disposed in the chamber and configured to integrate an extreme ultraviolet light generated from the plasma by reflecting the extreme ultraviolet light.

* * * * *